US012227826B2

(12) United States Patent
Kim

(10) Patent No.: US 12,227,826 B2
(45) Date of Patent: Feb. 18, 2025

(54) STEEL PLATE FOR PRESSURE VESSEL HAVING EXCELLENT HYDROGEN INDUCED CRACKING RESISTANCE AND METHOD OF MANUFACTURING SAME

(71) Applicant: POSCO, Pohang-si (KR)

(72) Inventor: Dae-Woo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 820 days.

(21) Appl. No.: 17/296,456

(22) PCT Filed: Nov. 29, 2019

(86) PCT No.: PCT/KR2019/016697
§ 371 (c)(1),
(2) Date: May 24, 2021

(87) PCT Pub. No.: WO2020/111858
PCT Pub. Date: Jun. 4, 2020

(65) Prior Publication Data

US 2021/0395867 A1 Dec. 23, 2021

(30) Foreign Application Priority Data

Nov. 30, 2018 (KR) ..... 10-2018-0153076

(51) Int. Cl.

| | |
|---|---|
| ***C22C 38/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |

(52) U.S. Cl.
CPC ..... *C22C 38/50* (2013.01); *C21D 8/0205* (2013.01); *C21D 8/0226* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C21D 2211/005* (2013.01)

(58) Field of Classification Search
CPC .... C21D 2211/005; C21D 1/28; C21D 6/005; C21D 8/0226; C21D 8/0263; C21D 8/0426; C21D 8/0463; C21D 9/46; C22C 38/04; C22C 38/12; C22C 38/24; C22C 38/26; C22C 38/46; C22C 38/48
See application file for complete search history.

(56) References Cited

U.S. PATENT DOCUMENTS

| | | | | |
|---|---|---|---|---|
| 9,809,869 | B2 | 11/2017 | Nakagawa et al. | |
| 2016/0230258 | A1 | 8/2016 | De | |
| 2018/0363111 | A1* | 12/2018 | Um | C22C 38/46 |
| 2020/0095649 | A1 | 3/2020 | Cha et al. | |

FOREIGN PATENT DOCUMENTS

| | | | | | |
|---|---|---|---|---|---|
| CN | 102719745 | A | | 10/2012 | |
| EP | 3395999 | A1 | | 10/2018 | |
| JP | H06-179911 | A | | 6/1994 | |
| JP | H06-220577 | A | | 8/1994 | |
| JP | H06-322477 | A | | 11/1994 | |
| JP | H08-283840 | A | | 10/1996 | |
| JP | 2000-144310 | A | | 5/2000 | |
| JP | 2003-013175 | A | | 1/2003 | |
| JP | 2005-290554 | A | | 10/2005 | |
| JP | 2014-005534 | A | | 1/2014 | |
| KR | 1020070099482 | A | * | 10/2007 | C22C 38/002 |
| KR | 10-0833069 | B1 | | 5/2008 | |
| KR | 10-0833071 | B1 | | 5/2008 | |
| KR | 10-2010-0076727 | A | | 7/2010 | |
| KR | 10-2011-0060449 | A | | 6/2011 | |
| KR | 10-2012-0074638 | A | | 7/2012 | |
| KR | 101253890 | B1 | * | 4/2013 | C21D 1/28 |
| KR | 10-2013-0110623 | A | | 10/2013 | |
| KR | 10-2014-0056760 | A | | 5/2014 | |
| KR | 10-2016-0075925 | A | | 6/2016 | |
| KR | 10-2018-0074281 | A | | 7/2018 | |
| WO | WO-2017105109 | A1 | * | 6/2017 | C21D 6/004 |
| WO | 2018/117545 | A1 | | 6/2018 | |

OTHER PUBLICATIONS

Extended European Search Report dated Feb. 22, 2022 issued in European Patent Application No. 19888554.3.
Chinese Office Action dated Nov. 21, 2022 issued in Chinese Patent Application No. 201980078921.0 (with English translation).
Wang Youming et al., "The Controlled Rolling and Cooling of Steel," University of Science and Technology, Beijing, May 31, 1995 (with English translation).
Japanese Office Action dated Aug. 2, 2022 issued in Japanese Patent Application No. 2021-530864.
International Search Report and Written Opinion issued in corresponding International Application No. PCT/ KR2019/016697 dated Mar. 5, 2020, with partial English translation.

* cited by examiner

*Primary Examiner* — Vanessa T. Luk
(74) *Attorney, Agent, or Firm* — Morgan, Lewis & Bockius LLP

(57) ABSTRACT

An embodiment of the present invention provides a steel plate for a pressure vessel having excellent hydrogen-induced cracking resistance and a method of manufacturing same, the steel plate comprising, in weight %, 0.2 to 0.3% of carbon (C), 0.05 to 0.50% of silicon (Si), 0.1% to 0.5% (exclusive) of manganese (Mn) , 0.005 to 0.1% of aluminum (Al), 0.010% or less of phosphorus (P) , 0.0015% or less of sulfur (S), 0.001 to 0.03% of niobium (Nb), 0.001 to 0.03% of vanadium (V) , 0.001 to 0.03% of titanium (Ti), 0.01 to 0.20% of chromium (Cr), 0.01 to 0.15% of molybdenum (Mo) , 0.01 to 0.50% of copper (Cu) , 0.05 to 0.50% of nickel (Ni), 0.0005 to 0.0040% of calcium (Ca), and the balance of Fe and other inevitable impurities, wherein the average grain size of ferrite is 5-20 μm.

4 Claims, No Drawings

STEEL PLATE FOR PRESSURE VESSEL HAVING EXCELLENT HYDROGEN INDUCED CRACKING RESISTANCE AND METHOD OF MANUFACTURING SAME

CROSS REFERENCE

This application is the U.S. National Phase under 35 U.S.C. § 371 of International Application No. PCT/KR2019/016697 filed on 29 Nov. 2019, which claims the benefit of Korean Application No. 10-2018-0153076 filed on 30 Nov. 2018, the entire contents of each are hereby incorporated by reference.

TECHNICAL FIELD

The present disclosure relates to a steel plate for a pressure vessel having excellent hydrogen induced cracking resistance and a method of manufacturing the same.

BACKGROUND ART

Recently, in accordance with an increase in time using a steel plate for a pressure vessel for use in a petrochemical production facility, a storage tank, and the like, a size of a facility has been increased and a steel plate has been thickened, and in order to secure structural stability of a welded portion together with a base material when manufacturing a large structure, there is a trend for lowering a carbon equivalent (Ceq) and extremely controlling impurities.

In addition, as production of crude oil containing a large amount of $H_2S$ is increased, quality properties for hydrogen induced cracking (HIC) resistance have become stricter.

In particular, a steel plate used in all types of plant facilities for mining, processing, transporting, and storing low-quality crude oil is also necessarily required to have properties of suppressing cracks caused by wet hydrogen sulfide contained in crude oil. Recently, as environmental contamination caused by accidents in plant facilities has become a global problem and a significantly large amount of money is required to restore contaminated environments, HIC resistance characteristics required in a steel plate used in the energy industry have become stricter.

Meanwhile, hydrogen induced cracking (HIC) occurs according to the following principle. A steel plate corrodes when the steel plate comes into contact with wet hydrogen sulfide contained in crude oil, and hydrogen generated by the corrosion penetrates and diffuses into steel. Then, the hydrogen is present in an atomic state in the steel. Gas pressure is generated while the hydrogen atoms are converted into hydrogen molecules in the form of hydrogen gas in the steel, and brittle cracks occur in a weak structure in the steel, for example, an inclusion, a segregation zone, an inner pore, or the like, due to the pressure. When the cracks widen gradually to exceed an endurable level of strength of a material, the steel plate is fractured.

Therefore, methods for improving hydrogen induced cracking resistance of a steel plate used in a hydrogen sulfide atmosphere have been proposed. Examples thereof are as follows: first, a method of adding an element such as copper (Cu), second, a method of improving resistance to initiation of cracks by changing a processing process to change a matrix structure to a hard structure such as tempered martensite or tempered bainite through water treatment such as normalizing and accelerated cooling and tempering (NACT), quenching and tempering (QT), or direct quenching and tempering (DQT), third, a method of controlling inner defects of inclusions and pores in steel, which may act as a site of hydrogen accumulation and an initiation point of cracks, and fourth, a method of minimizing a hardened structure (for example, a pearlite phase or the like) in which cracks easily occur and propagate or controlling a shape of the hardened structure.

The method of adding a predetermined amount of Cu has an effect of forming a stable CuS coating film on a surface of a material in a weak acidic atmosphere to reduce penetration of hydrogen into the material, thereby improving hydrogen induced cracking resistance. However, it is known that the effect through addition of Cu is not highly significant in a strong acidic atmosphere. In addition, the addition of Cu causes high-temperature cracking to induce cracks on a surface of the steel plate, resulting in increases in costs fora process such as surface polishing.

The second method is a method of forming a matrix phase into tempered martensite, tempered bainite, or a composite structure thereof rather than ferrite+pearlite through water treatment such as normalizing and accelerated cooling and tempering (NACT), quenching and tempering (QT), direct quenching and tempering (DQT), or thermo-mechanical controlled processing (TMCP) to increase strength of the matrix phase. In a case in which the strength of the matrix phase is increased, resistance to initiation of cracks is improved. Therefore, frequency of occurrence of cracks maybe relatively decreased. Patent Document 1 relating to the second method discloses that HIC resistance characteristics may be improved by a process of heating a slab containing, by wt %, 0.01 to 0.1% of C, 0.01 to 0.5% of Si, 0.8 to 2% of Mn, 0.025% or less of P, 0.002% or less of S, 0.0005 to 0.005% of Ca, 0.005 to 0.05% of Ti, 0.005 to 0.1% of Nb, 0.005 to 0.05% of sol .Al, 0.01% of N, 0.2% of V, 0.5% or less of Cu, 0.5% or less of Ni, 3% or less of Cr, 1.5% or less of Mo, and 0.002% or less of B, finish rolling the heated slab at 700 to 850° C., initiating accelerated cooling at Ar3 and a temperature of 30° C. or lower, and finishing the accelerated cooling at 350 to 550° C. In addition, Patent Document 2 also discloses that HIC resistance characteristics may be improved by securing a tempered martensite structure through a direct quenching and tempering (DQT) process. However, in a case in which the matrix phase is composed of a low-temperature phase (martensite, bainite, acicular ferrite, or the like), HIC resistance characteristics may be improved, but hot-forming is impossible. Therefore, it is difficult to manufacture a pressure vessel pipe, a uniform elongation value of a product is decreased due to a high surface hardness value, and an occurrence rate of surface cracks is increased in a processing process. In addition, in a case in which a cooling capability is insufficient during quenching, it may be difficult to secure a low-temperature transformation structure, and on the contrary, HIC resistance may be deteriorated due to formation of a martensite-austenite constituent (MA) phase which may act as an initiation point of HIC cracks.

The third method is a method of improving HIC resistance characteristics by significantly minimizing inclusions or pores in a slab to increase cleanliness, and a representative technology thereof is disclosed in Patent Document 3. Patent Document 3 discloses that when Ca is added to molten steel, in a case in which a content of Ca is controlled so as to satisfy $0.1 \leq (T.[Ca]-(17/18)\times T.[O]-1.25\times S)/T[O] \leq 0.5$, a steel plate having excellent HIC resistance characteristics may be manufactured. In a case in which a cumulative reduction amount is high as in a thin steel plate, the above method may prevent breakage of an oxidative inclusion, which may improve the HIC resistance. However, in a case in which segregation defects of Mn central segregation, a MnS inclusion, and the like are excessive, the HIC resistance is not improved by this method. In addition, as a thickness of the steel plate increases, HIC resistance defects occur due to central porosity defects rather than defects of the oxidative inclusion, and the remaining pores present at the central portion may not be sufficiently subjected to full mechanical bonding by rolling. Therefore, there is a limit in the above method.

The fourth method, which is a method of minimizing a hardened structure or controlling a shape of the hardened structure, is generally a method of reducing a band index (B.I) value of a band structure generated in a matrix phase after normalizing heat treatment to delay a crack propagation rate. Patent Document 4 relating to the fourth method discloses that a ferrite+pearlite microstructure having a banding index (measured according to ASTM E-1268) of 0.25 or less may be obtained by a process of heating a slab containing, by wt %, 0.1 to 0.30% of C, 0.15 to 0.40% of Si, 0.6 to 1.2% of Mn, 0.035% or less of P, 0.020% or less of S, 0.001 to 0.05% of Al, 0.35% or less of Cr, 0.5% or less of Ni, 0.5% or less of Cu, 0.2% or less of Mo, 0.05% or less of V, 0.05% or less of Nb, 0.0005 to 0.005% of Ca, 0.005 to 0.025% of Ti, and 0.0020 to 0.0060% of N, hot rolling the heated slab, air cooling the hot-rolled slab at room temperature, heating the air-cooled slab at a transformation point of Ac1 to Ac3, and slowly cooling the heated slab, and steel having excellent HIC resistance characteristics (average cracking length ratio (CLR) based on National Association of Corrosion Engineers (NACE): 0) with a tensile strength of approximately 500 MPa may be obtained by the process. However, the banding index increases as contents of C and Mn increase or a reduction amount of a thick steel plate increases. Thus, there is a limit in manufacturing a thin steel plate having a thickness of 50 mm or less within the suggested condition ranges of C and Mn. In addition, in a case in which soft reduction and second cooling conditions are not appropriate in a continuous casting process, a segregation degree of Mn at the central portion is further increased, such that a portion at which a banding index value is high may locally exist toward the central portion even in a case in which a banding index of each of a surface portion and a ¼t portion of a steel plate is low. Therefore, it is difficult to secure excellent HIC resistance in the entire thickness range.

Therefore, each of the above-described methods according to the related art has a limit in manufacturing steel for a pressure vessel having hydrogen induced cracking resistance characteristics with a thickness of 6 to 100 mm and a tensile strength of approximately 485 to 620 MPa.

[Related Art Document]

(Patent Document 1) Japanese Patent Laid-Open Publication No. 2003-013175

(Patent Document 2) Korean Patent Publication No.

(Patent Document 3) Japanese Patent Laid-Open Publication No. 2014-005534

(Patent Document 4) Korean Patent Laid-Open Publication No. 2010-0076727

DISCLOSURE

Technical Problem

An aspect of the present disclosure may provide a steel plate for a pressure vessel having excellent hydrogen induced cracking (HIC) resistance in a hydrogen sulfide atmosphere and a method of manufacturing the same.

Technical Solution

According to an aspect of the present disclosure, a steel plate for a pressure vessel having excellent hydrogen induced cracking resistance contains, by wt %, 0.2 to 0.3% of carbon (C), 0.05 to 0.50% of silicon (Si), 0.1% or more to less than 0.5% of manganese (Mn), 0.005 to 0.1% of aluminum (Al), 0.010% or less of phosphorus (P) , 0.0015% or less of sulfur (S), 0.001 to 0.03% of niobium (Nb), 0.001 to 0.03% of vanadium (V), 0.001 to 0.03% of titanium (Ti), 0.01 to 0.20% of chromium (Cr), 0.01 to 0.15% of molybdenum (Mo), 0.01 to 0.50% of copper (Cu), 0.05 to 0.50% of nickel (Ni), 0.0005 to 0.0040% of calcium (Ca), and a balance of Fe and other unavoidable impurities, wherein an average ferrite grain size is 5 to 20 μ.

According to another aspect of the present disclosure, a method of manufacturing a steel plate for a pressure vessel having excellent hydrogen induced cracking resistance includes: reheating a steel slab containing, by wt %, 0.2 to 0.3% of carbon (C) , 0.05 to 0.50% of silicon (Si), 0.1% or more to less than 0.5% of manganese (Mn), 0.005 to 0.1% of aluminum (Al) , 0.010% or less of phosphorus (P) , 0.0015% or less of sulfur (S), 0.001 to 0.03% of niobium (Nb), 0.001 to 0.03% of vanadium (V) , 0.001 to 0.03% of titanium (Ti) , 0.01 to 0.20% of chromium (Cr) , 0.01 to 0.15% of molybdenum (Mo) , 0.01 to 0.50% of copper (Cu) , 0.05 to 0.50% of nickel (Ni), 0.0005 to 0.0040% of calcium (Ca), and a balance of Fe and other unavoidable impurities at 1,000 to 1,100° C.; hot rolling the reheated steel slab at a non-recrystallization region temperature of 800 to 950° C. and an average reduction ratio per pass of 15% or more to obtain a hot-rolled steel plate; and air cooling the hot-rolled steel plate to room temperature and then performing normalizing heat treatment on the air-cooled steel plate by heating the air-cooled steel plate to 800 to 900° C. and maintaining the heated steel plate for 15 to 60 minutes.

ADVANTAGEOUS EFFECTS

As set forth above, according to an exemplary embodiment in the present disclosure, a steel plate for a pressure vessel having excellent hydrogen induced cracking (HIC) resistance in a hydrogen sulfide atmosphere and a method of manufacturing the same may be provided.

BEST MODE FOR INVENTION

The present disclosure has features for further improving strength and hydrogen induced cracking resistance of a steel plate by controlling an alloy composition, a microstructure, a concentration degree of Mn at the central portion, a ferrite grain size, and the like.

Main concepts of the present disclosure are divided into the following two parts: alloy design and process control.

1) In the present disclosure, Mn is controlled in a range of 0.1 to 0.5 wt % in order to suppress segregation of Mn and formation of pearlite having a band structure at the central portion of a product. In a normalized steel plate having strength similar to that of the present disclosure, a content of Mn is generally 1.0 to 1.4 wt %, and when addition of Mn is excluded, a solid solution strengthening effect of Mn in a ferrite matrix is completely offset, and thus, a rapid decrease in strength is caused. In the present disclosure, a content of C is increased to compensate for such a decrease in strength.

In the normalized steel plate having strength similar to that of the present disclosure, the content of C is generally 0.13 to 0.18 wt %. On the other hand, in the present disclosure, the content of C is increased to approximately 0.2 to 0.25 wt % to increase a fraction of pearlite, thereby increasing the strength. C has a lower diffusion coefficient between Delta/Liquid or Gamma/Liquid phases at a high temperature than Mn, but has a significantly higher diffusion coefficient in an austenite single phase than Mn. Therefore, C may be entirely diffused during normalizing heat treatment even in a case in which segregation occurs. As a result, segregation may not occur at the central portion of a final product.

2) In a case in which ferrite grains are refined after phase transformation, both strength and toughness of a steel plate are improved, and an average propagation length of cracks after occurrence of hydrogen induced cracking is increased, such that a crack propagation rate is reduced. Therefore, hydrogen induced cracking propagation resistance may also improved. It is required to refine an austenite grain size before phase transformation in order to refine a ferrite grain size, but, grain growth occurs after rolling at a high temperature and a transformation resistance value of austenite is increased at a low non-recrystallization region temperature. Therefore, there is a limit in a maximum load which may be applied at the time of rolling. Accordingly, it is difficult to effectively increase a ferrite nucleation site. Thus, it is not easy to control an average ferrite grain size to 20 μm or less. In the present disclosure, the transformation resistance value may be relatively reduced by controlling a content of Mn to be low, such as 0.1 to 0.5%, and the ferrite nucleation site may be generated as much as possible at a non-recrystallization region temperature by increasing an average reduction ratio per pass at 850° C. to 15% or more from 8% of an average reduction ratio per pass according to the related art.

3) As a thickness of a product increases, Nb (C,N) carbonitrides grow and coarsen in an air cooling process after rolling. It is most preferable that the Nb (C,N) carbonitrides are formed in a normalizing process after the rolling is finished. However, when the coarse Nb (C,N) carbonitrides are present after the rolling, a fine precipitate is not newly formed in the normalizing heat treatment process, but the Nb (C,N) carbonitrides present in the existing matrix continuously grow. Therefore, an appropriate precipitation strengthening effect may not be expected. In order to prevent this, in the present disclosure, after the rolling is finished, a steel plate having a thickness of 50 mm or more is subjected to accelerated cooling to 400° C. or lower, such that the growth of the carbonitrides is effectively suppressed.

Hereinafter, a steel plate for a pressure vessel having excellent hydrogen induced cracking resistance according to an exemplary embodiment in the present disclosure will be described in detail. First, an alloy composition according to the present disclosure will be described. Unless specifically stated otherwise, a unit of the alloy composition described below refers to "wt %".

Carbon (C) : 0.2 to 0.3%

C is the most important element to secure basic strength of steel, and thus, C is required to be contained in the steel in an appropriate range. It is preferable that a content of C added is 0.2% or more to obtain this addition effect. However, when the content of C exceeds 0.3%, a ferrite+bainite structure is formed in a steel plate having a thickness of less than 10 mm in an air cooling process, and thus, strength or hardness of the steel plate may be excessively increased. In particular, HIC resistance characteristics are also deteriorated at the time of forming a martensite-austenite constituent (MA) structure. Therefore, the content of C is preferably 0.2 to 0.3%.

Silicon (Si): 0.05 to 0.50%

Si, which is a substitutional element, improves strength of the steel plate through solid solution strengthening and has a strong deoxidation effect, and thus, Si is an essential element for manufacturing clean steel. Therefore, it is preferable that a content of Si added is 0.05% or more. However, when the content of Si exceeds 0.50%, an MA phase is formed, and an excessive increase in strength of a ferrite matrix structure is caused, resulting in deterioration of HIC resistance characteristics, impact toughness, and the like. Therefore, the content of Si is preferably 0.05 to 0.50%. A lower limit of the content of Si is more preferably 0.20%.

Manganese (Mn): 0.1% or more to less than 0.5%

Mn is an element useful in improving the strength by solid solution strengthening and in improving hardenability to forma low-temperature transformation phase. In the present disclosure, it is preferable that a content of Mn added is 0.1% or more to sufficiently obtain the above effects. Meanwhile, the content of Mn added to an existing steel plate having a tensile strength of approximately 485 to 620 MPa is generally 1.0 to 1.4% in order to improve the HIC resistance characteristics. However, as the content of Mn is increased, a banded pearlite structure is formed in a rolling process, resulting in deterioration of HIC resistance quality. In addition, a segregation degree of Mn at the central portion of the product is increased and a high-temperature deformation resistance value is also rapidly increased. Thus, there is a limit in setting of a maximum reduction amount in a non-recrystallization region. Therefore, in the present disclosure, it is preferable that the content of Mn is controlled to less than 0.5% to form a fine ferrite+pearlite microstructure rather than a band form in the entire thickness range of the product. Accordingly, the content of Mn is preferably 0.1% or more to less than 0.5%. A lower limit of the content of Mn is more preferably 0.15% and still more preferably 0.2%. An upper limit of the content of Mn is more preferably 0.45% and still more preferably 0.4%.

Aluminum (Al): 0.005 to 0.1%

Al is one of strong deoxidizing agents together with Si in a steel manufacturing process. It is preferable that a content of Al added is 0.005% or more to obtain the effect thereof. However, when the content of Al exceeds 0.1%, an excessive increase in fraction of $Al_2O_3$ in an oxidative inclusion generated as a product of deoxidization is caused, and thus, a size of $Al_2O_3$ coarsens, and it is difficult to remove $Al_2O_3$ during refining, resulting in deterioration of hydrogen induced cracking resistance due to the oxidative inclusion. Therefore, the content of Al is preferably 0.005 to 0.1%.

Phosphorus (P) : 0.010% or less

P is an element causing brittleness at a grain boundary or forming a coarse inclusion to cause brittleness.

It is preferable that a content of P is controlled to 0.010% or less to improve resistance to propagation of brittle cracks.

Sulfur (S) : 0.0015% or less

S is an element causing brittleness at a grain boundary or forming a coarse inclusion to cause brittleness. It is preferable that a content of S is controlled to 0.0015% or less to improve resistance to propagation of brittle cracks.

Niobium (Nb) : 0.001 to 0.03%

Nb precipitates in the form of NbC or Nb (C,N) to improve strength of a base material. In addition, solid-dissolved Nb at the time of reheating at a high temperature precipitates very finely in the form of NbC during rolling to suppress recrystallization of austenite, thereby refining the structure. It is preferable that a content of Nb added is 0.001% or more to obtain the above effects. However, when the content of Nb exceeds 0.03%, undissolved Nb is generated in the form of Ti,Nb(C,N) , which may cause UT defects, deterioration of impact toughness, and deterioration of hydrogen induced cracking resistance. Therefore, the content of Nb is preferably 0.001 to 0.03%.

Vanadium (V): 0.001 to 0.03%

V is almost completely re-solid-dissolved at the time of reheating, and thus, V has an insufficient reinforcing effect through precipitation or solid solution in a subsequent rolling process. However, V precipitates in the form of very fine carbonitrides in a subsequent heat treatment process such as post weld heat treatment (PWHT) to improve strength. A content of V is required to be 0.001% or more to sufficiently obtain the above effects. However, when the content of V exceeds 0.03%, an excessive increase in each of strength and hardness of a welded portion is caused, which may cause surface cracks during processing of the steel plate into a pressure vessel. In addition, a manufacturing cost is significantly increased, which is economically disadvantageous. Therefore, the content of V is preferably 0.001 to 0.003%.

Titanium (Ti): 0.001 to 0.03%

Ti is a component that precipitates in the form of TiN at the time of reheating and suppresses grain growth in a base material and a weld heat-affected portion to significantly improve low-temperature toughness. It is preferable that a content of Ti added is 0.001% or more to obtain the addition effect. However, when the content of Ti exceeds 0.03%, the low-temperature toughness may be reduced due to clogging of a continuous casting nozzle or crystallization at the central portion, and in a case in which Ti combines with N to form a coarse TiN precipitate at the central portion in a thickness direction, Ti may act as an initiation point of hydrogen induced cracking. Therefore, the content of Ti is preferably 0.001 to 0.03%.

Chromium (Cr) : 0.01 to 0.20%

Cr has an insufficient effect of increasing a yield strength and a tensile strength by solid solution, but has an effect of preventing a decrease in strength by delaying a degradation rate of cementite during tempering or post weld heat treatment (PWHT) that is a subsequent process. It is preferable that a content of Cr added is 0.01% or more to obtain the above effects. However, when the content of Cr exceeds 0.20%, increases in size and fraction of Cr-Rich coarse carbides such as $M_{23}C_6$ are caused, resulting in significant deterioration of impact toughness. As a result, a manufacturing cost is increased and weldability is deteriorated. Therefore, the content of Cr is preferably 0.01 to 0.20%.

Molybdenum (Mo) : 0.01 to 0.15%

Mo is an element effective in preventing a decrease in strength during tempering or post weld heat treatment (PWHT) that is a subsequent process, similarly to Cr, and has an effect of preventing deterioration of toughness due to grain boundary segregation of impurities such as P. In addition, Mo is a solid solution strengthening element in ferrite and has an effect of increasing strength of a matrix phase. It is preferable that a content of Mo added is 0.01% or more to obtain the above effects. However, since Mo is an expensive element, when Mo is excessively added, a manufacturing cost may be significantly increased. Thus, the content of Mo added is preferably 0.15% or less. Therefore, the content of Mo is preferably 0.01 to 0.15%.

Copper (Cu) : 0.01 to 0.50%

Copper (Cu) is an element that is advantageous in the present disclosure because Cu has an effect of significantly increasing strength of a matrix phase by solid solution strengthening in ferrite and suppressing corrosion in a wet hydrogen sulfide atmosphere. A content of Cu added is required to be 0.01% or more to sufficiently obtain the above effects.

However, when the content of Cu exceeds 0.50%, star cracks are likely to occur on a surface of a steel plate, and a manufacturing cost is significantly increased because Cu is an expensive element. Therefore, the content of Cu is preferably 0.01 to 0.50%.

Nickel (Ni): 0.05 to 0.50%

Ni is an element that is important for increasing lamination defects at a low temperature to easily form a cross slip with an electric potential so as to improve impact toughness and hardenability, thereby increasing strength. It is preferable that a content of Ni added is 0.05% or more to obtain the above effects. However, when the content of Ni exceeds 0.50%, an excessive increase in hardenability may be caused, and a manufacturing cost may be increased because Cu is more expensive than other hardenability-improving elements. Therefore, the content of Ni is preferably 0.05 to 0.50%.

Calcium (Ca): 0.0005 to 0.0040%

When Ca is added after deoxidization by Al, Ca combines with S forming MnS inclusions to suppress generation of MnS, and also has an effect of forming spherical CaS to suppress occurrence of cracks due to hydrogen induced cracking. In the present disclosure, it is preferable that a content of Ca added is 0.0005% or more in order to sufficiently form S contained as impurities into CaS. However, when the content of Ca exceeds 0.0040%, Ca remaining after forming CaS combines with 0 to form a coarse oxidative inclusion, and the coarse oxidative inclusion is stretched and broken at the time of rolling, which causes hydrogen induced cracking. Therefore, the content of Ca is preferably 0.0005 to 0.0040%.

The remaining component of the present disclosure is iron (Fe). However, unintended impurities maybe inevitably mixed from raw materials or surrounding environments in a general manufacturing process. Therefore, it is difficult to exclude these impurities. Since these impurities may be recognized in the general manufacturing process by those skilled in the art, all the contents thereof are not particularly described in the present specification.

In the steel plate provided in the present disclosure, an average ferrite grain size is preferably 5 to 20 μm. When the average ferrite grain size is less than 5 μm, there is a physical limit in reducing an austenite grain size by rolling. When the average ferrite grain size exceeds 20 μm, a ductile to brittle transition temperature (DBTT) is increased in an impact transition test, resulting in deterioration of impact toughness.

Meanwhile, it is preferable that the steel plate according to the present disclosure contains, in an area fraction, 70% or more of ferrite and a balance of pearlite. When the fraction of ferrite is less than 70%, the fraction of pearlite is relatively high, resulting in deterioration of impact toughness.

In addition, it is preferable that a maximum concentration of Mn at the central portion of the steel plate according to the present disclosure is 0.6 wt % or less. When the maximum concentration of Mn at the central portion exceeds 0.6 wt %, MnS or a low-temperature transformation phase may be formed due to component concentration by segregation. Meanwhile, the central portion described in the present disclosure refers to a region occupying +5% of a total thickness of a product at 1/2t (t: a thickness of the product).

[0091]

Further, it is preferable that the steel plate according to the present disclosure contains 0.01 to 0.02 wt % of Nb (C,N) or V (C,N) carbonitrides having an average diameter of 5 to 20 nm after PWHT. When the average diameter of the Nb (C,N) or V (C,N) carbonitrides is more than 20 nm or less than 5 nm, the effect through precipitation strengthening may not be sufficiently obtained. When a fraction of the Nb (C,N) or V (C,N) carbonitrides is less than 0.01 wt %, the fraction of the carbonitrides is low, and thus, the effect through precipitation strengthening may not be sufficiently obtained. When the fraction of the Nb (C,N) or V (C,N)

carbonitrides exceeds 0.02 wt %, an excessive increase in hardness of a welded portion is caused, resulting in weld cracking.

In addition, it is preferable that a thickness of the steel plate according to the present disclosure is 6 to 100 mm. When the thickness of the steel plate is less than 6 mm, it is difficult to manufacture a product with a rolling mill for a thick steel plate, and when the thickness of the steel plate exceeds 100 mm, it is difficult to secure a tensile strength of 485 MPa or more desired in the present disclosure.

The steel plate according to the present disclosure provided as described above may have a tensile strength of 485 to 620 MPa.

Hereinafter, a method of manufacturing a steel plate for a pressure vessel having excellent hydrogen induced cracking resistance according to an exemplary embodiment in the present disclosure will be described in detail.

First, a steel slab having the alloy composition described above is reheated at 1,000 to 1,100° C. It is preferable that the reheating of the steel slab is performed at 1,000° C. or higher in order to prevent an excessive decrease in temperature in a subsequent rolling process. However, when the temperature in the reheating of the steel slab is higher than 1,100° C., a total reduction amount is insufficient at a non-recrystallization region temperature, and even in a case in which an initial temperature of control rolling is low, cost competitiveness for operation is low due to excessive air cooling. Therefore, the temperature in the reheating of the steel slab is preferably 1,000 to 1,100° C.

Thereafter, the reheated steel slab is hot rolled at a non-recrystallization region temperature of 800 to 950° C. and an average reduction ratio per pass of 15% or more to obtain a hot-rolled steel plate. When the temperature in the hot rolling is lower than 800° C., the slab may be rolled in an austenite-ferrite dual-phase region, and thus, the slab may not be rolled to have a normal target thickness. When the temperature in the hot rolling is higher than 950° C., austenite grains coarsen excessively, and thus, improvements of strength and HIC resistance characteristics by grain refinement may not be expected. In addition, when the average reduction ratio per pass is less than 15%, a ferrite nucleation site is not sufficiently formed in a non-recrystallization region. Thus, it is difficult to control an average ferrite grain size after the normalizing heat treatment to 20 μm or less. Therefore, the average reduction ratio per pass during the hot rolling is preferably controlled to 15% or more. However, in consideration of a roll mill limit reduction amount, roll life, and the like for each mill, the average reduction ratio per pass is preferably 30% or less.

An average austenite grain size in the hot-rolled steel plate after the hot rolling is preferably 30 μm or less. As described above, the average austenite grain size in the hot-rolled steel plate after the hot rolling is controlled to 30 μm or less, such that the average ferrite grain size to be finally obtained may be refined. The average austenite grain size in the hot-rolled steel plate after the hot rolling is preferably 25 μm or less and more preferably 20 μm or less.

Thereafter, the hot-rolled steel plate is air cooled to room temperature, and then the air-cooled steel plate was subjected to normalizing heat treatment by heating the air-cooled steel plate to 800 to 900° C. and maintaining the heated steel plate for 15 to 60 minutes. The normalizing heat treatment is performed for sufficient uniformity of the austenite structure and sufficient diffusion of a solute. When the temperature in the normalizing heat treatment is lower than 800° C. or the time of the normalizing heat treatment is shorter than 15 minutes, the above effects may not be sufficiently obtained. However, when the temperature in the normalizing heat treatment is higher than 900° C. or the time of the normalizing heat treatment is longer than 60 minutes, fine precipitates such as NbC and VC may coarsen.

Meanwhile, the air cooling process may be applied to all the hot-rolled steel plates having a thickness of 6 to 100 mm, which are targeted in the present disclosure. However, when a thickness of the hot-rolled steel plate is more than 50 mm to 100 mm or less, the hot-rolled steel plate may be subjected to an accelerated cooling process to 400° C. or lower at 5° C./s or more based on 1/4t (t: a thickness of the steel plate) instead of the air cooling process. When the thickness of the hot-rolled steel plate exceeds 50 mm, in the air cooling process after the rolling, the Nb (C, N) carbonitrides may grow coarsely. When the coarse Nb (C, N) carbonitrides are present, fine NbC precipitates are not newly formed in the normalizing heat treatment process, but the existing Nb (C,N) precipitates continuously coarsen, which may decrease an appropriate precipitation strengthening effect. Therefore, after the rolling is finished, the hot-rolled steel plate having a thickness of more than 50 mm is subjected to accelerated cooling to 400° C. or lower at a cooling rate of 5° C./s or more based on ¼t (t: the thickness of the steel plate) , such that the growth of the carbonitrides may be effectively suppressed in the air cooling process. Meanwhile, in consideration of a limit of an accelerated cooling facility, the cooling rate during the accelerated cooling may be 20° C./s or less based on ¼t in a thickness direction of the steel plate having a thickness of 100 mm.

MODE FOR INVENTION

Hereinafter, the present disclosure will be described in more detail with reference to examples. However, the following examples are provided to illustrate and describe the present disclosure in more detail, but are not intended to limit the scope of the present disclosure. This is because the scope of the present disclosure is determined by contents disclosed in the claims and contents reasonably inferred therefrom.

EXAMPLES

Each of steel slabs having alloy compositions shown in Table 1 was reheated at 1,070° C., the reheated steel slab was hot rolled under conditions shown in Table 2 to obtain a hot-rolled steel plate having a thickness of 100 mm, the hot-rolled steel plate was air cooled to room temperature, and then the air-cooled steel plate was subjected to a normalizing heat treatment by maintaining the steel plate at 890° C. for 30 minutes.

A maximum concentration of Mn at the central portion of each of the steel plates manufactured as described above was measured using electron back scattered diffraction (EBSD), microstructures at ¼t (t is a thickness) and the central portion (½t) of the steel plate were analyzed with an optical microscope, the steel plate was subjected to the normalizing heat treatment, and an average ferrite grain size was measured. The results are shown in Table 2.

Finally, a tensile strength test and an HIC resistance test were carried out to evaluate the quality of the product. The results are shown in Table 2. In this case, a hydrogen induced cracking (HIC) length ratio (CLR, %) in a length direction of a plate used as an index of hydrogen induced cracking resistance of the steel plate was evaluated by dipping a specimen in a $H_2S$ gas-saturated 5% NACl+0.5% $CH_3COOH$ solution (1 atm) for 96 hours according to the related international standard NACE TM0284, measuring lengths of cracks by an ultrasonic testing method, and calculating a value by dividing a sum of the lengths of the cracks in a length direction of the specimen by a total length of the specimen. The tensile strength test was carried out at room temperature. The result was expressed as an average of two evaluation results.

TABLE 1

| Steel type No. | Alloy composition (wt %) | | | | | | | | | | | | | |
|---|---|---|---|---|---|---|---|---|---|---|---|---|---|---|
| | C | Si | Mn | Al | P | S | Nb | V | Ti | Cr | Mo | Cu | Ni | Ca |
| Inventive Steel 1 | 0.23 | 0.35 | 0.48 | 0.035 | 80 | 8 | 0.007 | 0.006 | 0.001 | 0.03 | 0.05 | 0.05 | 0.1 | 35 |
| Inventive Steel 2 | 0.25 | 0.31 | 0.47 | 0.031 | 70 | 6 | 0.010 | 0.008 | 0.011 | 0.02 | 0.07 | 0.08 | 0.2 | 31 |
| Inventive Steel 3 | 0.27 | 0.33 | 0.49 | 0.030 | 81 | 7 | 0.008 | 0.015 | 0.008 | 0.05 | 0.04 | 0.08 | 0.15 | 27 |
| Inventive Steel 4 | 0.28 | 0.35 | 0.43 | 0.036 | 70 | 8 | 0.013 | 0.013 | 0.012 | 0.05 | 0.08 | 0.15 | 0.25 | 29 |
| Inventive Steel 5 | 0.26 | 0.33 | 0.49 | 0.035 | 65 | 6 | 0.015 | 0.015 | 0.008 | 0.07 | 0.05 | 0.25 | 0.13 | 25 |
| Comparative Steel 1 | 0.25 | 0.36 | 1.45 | 0.030 | 70 | 7 | 0.020 | 0.012 | 0.006 | 0.08 | 0.07 | 0.08 | 0.30 | 25 |
| Comparative Steel 2 | 0.27 | 0.37 | 1.11 | 0.031 | 80 | 8 | 0.020 | 0.011 | 0.007 | 0.08 | 0.07 | 0.15 | 0.35 | 28 |
| Comparative Steel 3 | 0.13 | 0.30 | 0.01 | 0.030 | 80 | 8 | 0.015 | 0.010 | 0.011 | 0.08 | 0.12 | 0.13 | 0.27 | 23 |

Here, a unit of each of P, S, and Ca is ppm based on weight.

TABLE 2

| Classification | Steel type No. | Finish rolling temperature (° C.) | Average reduction ratio per pass (%) | Maximum concentration of Mn at central portion (wt %) | Microstructure 1/4t | Microstructure 1/2t | Average ferrite grain size (μm) | Tensile strength (MPa) | HIC, CLR (%) |
|---|---|---|---|---|---|---|---|---|---|
| Inventive Example 1 | Inventive Steel 1 | 851 | 15 | 0.02 | 77% F + 23% P | | 9.8 | 510 | 0 |
| Inventive Example 2 | Inventive Steel 2 | 881 | 17 | 0.01 | 75% F + 25% P | | 8.5 | 530 | 0 |
| Inventive Example 3 | Inventive Steel 3 | 881 | 20 | 0.03 | 73% F + 27% P | | 7.3 | 550 | 0 |
| Inventive Example 4 | Inventive Steel 4 | 840 | 19 | 0.01 | 76% F + 24% P | | 9.1 | 500 | 0 |
| Inventive Example 5 | Inventive Steel 5 | 831 | 20 | 0.02 | 77% F + 23% P | | 8.8 | 512 | 0 |
| Comparative Example 1 | Inventive Steel 1 | 1003 | 23 | 0.02 | 73% F + 27% P | | 22 | 471 | 3 |
| Comparative Example 2 | Inventive Steel 2 | 1001 | 6 | 0.01 | 72% F + 28% P | | 35 | 462 | 2 |
| Comparative Example 3 | Inventive Steel 3 | 805 | 9 | 0.01 | 74% F + 26% P | | 31 | 481 | 1 |
| Comparative Example 4 | Inventive Steel 4 | 771 | 4 | 0.01 | 75% F + 25% P | | 26 | 476 | 3 |
| Comparative Example 5 | Inventive Steel 5 | 779 | 5 | 0.01 | 74% F + 26% P | | 29 | 477 | 5 |
| Comparative Example 6 | Comparative Steel 1 | 883 | 19 | 4.15 | 72% T + 100% M 28% BP | | 8.8 | 535 | 39 |
| Comparative Example 7 | Comparative Steel 2 | 861 | 17 | 3.31 | 71% T + 100% B 29% BP | | 7.6 | 498 | 27 |
| Comparative Example 8 | Comparative Steel 3 | 872 | 19 | 0.01 | 86% F + 14% P | | 8.1 | 403 | 0 |

F: Ferrite, P: Pearlite, BP: Banded pearlite, M: Martensite, MA: Martensite-austenite constituent, B: Bainite As can be seen in Tables 1 and 2, it could be confirmed that in Inventive Examples 1 to 5 satisfying the alloy composition and the manufacturing conditions suggested by the present disclosure, both ¼t and the central portion (½t) of the steel plate had a pearlite composite structure rather than a band form with ferrite, a significantly fine average ferrite grain size of 5 to 20 μm, and a tensile strength of 485 MPa or more, which showed that the HIC resistance characteristics were significantly excellent.

However, it could be confirmed that in Comparative Examples 1 to 5, the alloy composition suggested by the present disclosure was satisfied, but the finish rolling temperature or the reduction ratio per pass during the rolling among the manufacturing conditions were not satisfied, and thus, the average ferrite grain size was significantly increased, resulting in deterioration of the tensile strength and the HIC resistance quality.

It could be confirmed that in Comparative Examples 6 and 7, the manufacturing conditions suggested by the present disclosure were satisfied, but the content of Mn of the alloy composition was not satisfied, and thus, the maximum concentration of Mn at the central portion was significantly high, resulting in deterioration of the HIC resistance.

It could be confirmed that in Comparative Example 8, the manufacturing conditions suggested by the present disclosure were satisfied, but the content of C of the alloy composition was not satisfied, and thus, the tensile strength was low.

The invention claimed is:

1. A steel plate for a pressure vessel having excellent hydrogen induced cracking resistance, the steel plate comprising, by wt %, 0.2 to 0.3% of carbon (C), 0.05 to 0.50% of silicon (Si), 0.1% or more to less than 0.5% of manganese (Mn), 0.005 to 0.1% of aluminum (Al), 0.010% or less of phosphorus (P), 0.0015% or less of sulfur(S), 0.001 to 0.03% of niobium (Nb), 0.001 to 0.03% of vanadium (V), 0.001 to 0.03% of titanium (Ti), 0.01 to 0.20% of chromium (Cr), 0.01 to 0.15% of molybdenum (Mo), 0.01 to 0.50% of copper (Cu), 0.05 to 0.50% of nickel (Ni), 0.0005 to 0.0040% of calcium (Ca), and a balance of Fe and other unavoidable impurities, wherein an average ferrite grain size is 5 to 20 μm, and wherein the steel plate contains 0.01 to 0.02 wt % of Nb (C,N) or V (C,N) carbonitrides having an average diameter of 5 to 20 nm after post weld heat treatment (PWHT).

2. The steel plate of claim 1, wherein the steel plate has a microstructure containing, in an area fraction, 70% or more of ferrite and a balance of pearlite.

3. The steel plate of claim 1, wherein a maximum concentration of Mn at the central portion of the steel plate is 0.6 wt % or less.

4. The steel plate of claim 1, wherein a thickness of the steel plate is 6 to 100 mm.

* * * * *